United States Patent [19]

Mayer

[11] 4,100,758

[45] Jul. 18, 1978

[54] VACUUM ASSIST FUEL SYSTEM

[75] Inventor: Edward A. Mayer, Newburgh, N.Y.

[73] Assignee: Texaco Inc., New York, N.Y.

[21] Appl. No.: 743,248

[22] Filed: Nov. 19, 1976

[51] Int. Cl.[2] ..... F17C 7/02

[52] U.S. Cl. ..... 62/54; 55/88; 55/89; 141/45; 220/85 VR

[58] Field of Search ..... 62/54, 55; 55/88, 89; 220/85 VR, 85 VS; 141/44, 45

[56] References Cited

U.S. PATENT DOCUMENTS

| | | | |
|---|---|---|---|
| 3,672,180 | 6/1972 | Davis | 62/54 |
| 3,690,115 | 9/1972 | Clayton | 62/55 |
| 3,756,291 | 9/1973 | McGahey et al. | 62/54 |
| 3,763,901 | 10/1973 | Viland | 62/54 |
| 3,791,422 | 2/1974 | Johnson et al. | 62/54 |
| 3,921,412 | 11/1975 | Heath et al. | 62/54 |
| 3,994,322 | 11/1976 | Overall | 62/54 |

*Primary Examiner*—Ronald C. Capossela

*Attorney, Agent, or Firm*—Thomas H. Whaley; Carl G. Ries; Robert B. Burns

[57] ABSTRACT

A system for transferring a volatile liquid such as a fuel into a tank, from a storage facility. A nozzle sealably and removably engages the tank to pass a flow of liquid to the tank, and to return vapors therefrom to the storage facility. The fuel passing to the nozzle is chilled in accordance with the pressure in the storage facility, whereby to maintain a vacuum in the storage facility and therefore at the nozzle tank interface.

7 Claims, 1 Drawing Figure

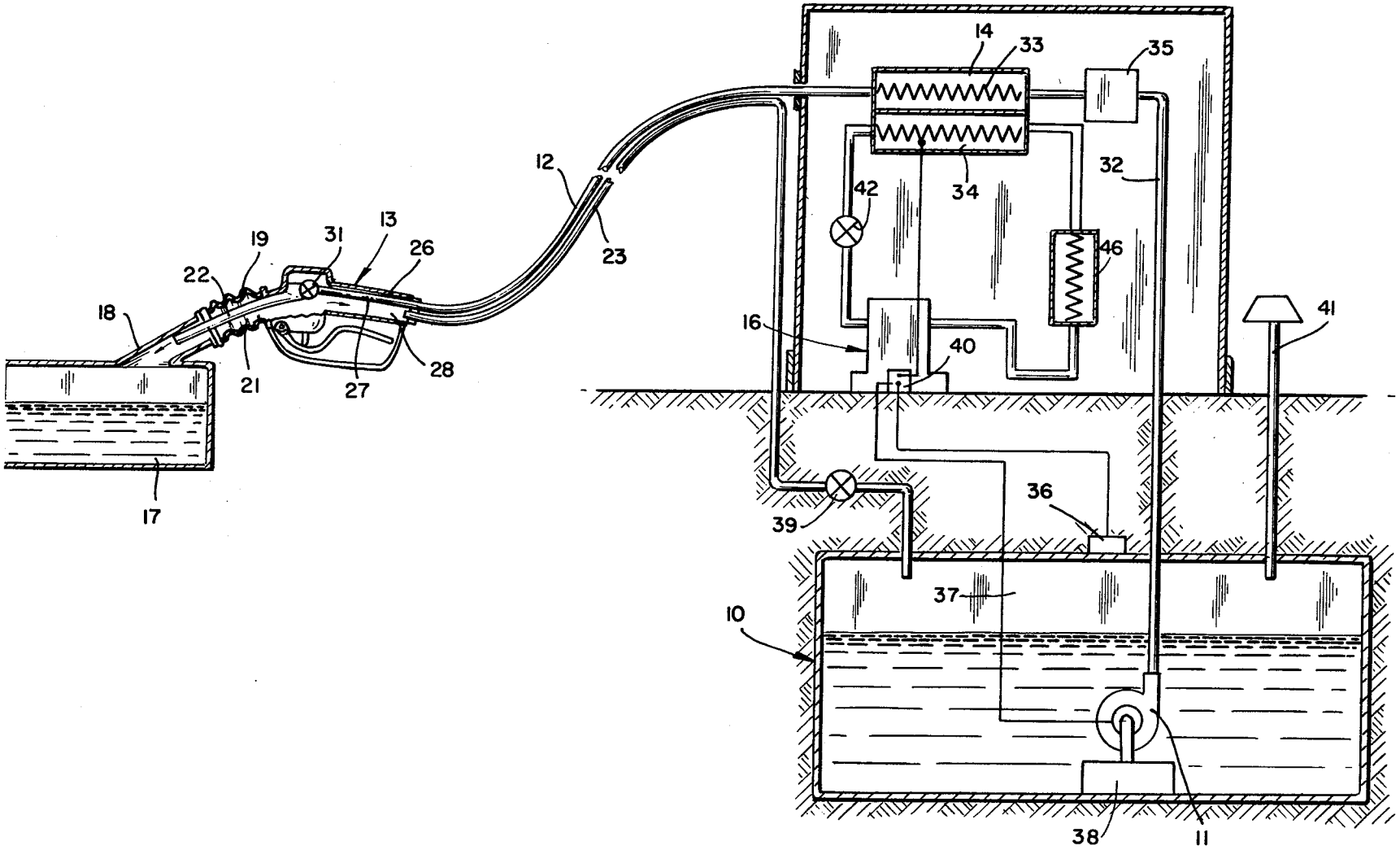
41
35
32
46
33
14
34
40
42
16
36
37
39
10
11
38
23
12
28
26
13
27
31
19
21
22
18
17

VACUUM ASSIST FUEL SYSTEM

BACKGROUND OF THE INVENTION

During the transfer of a volatile liquid such as gasoline or a similar fuel, from a storage facility to a tank, there is normally an unsealed connection made between the disconnectable nozzle and the tank being filled. As the fuel transfer operation progresses, residual fuel vapor air mixture displaced from the tank normally passes into the atmosphere.

Many municipalities and governmental agencies have proposed or adopted regulations to reduce these emissions. One method toward complying with mandated regulations is the provision of a completely closed or balanced system between the fuel source and the tank being filled.

In the instance of a closed system, the latter normally includes a conduit which carries fuel, the remote end of which is communicated with a manually operated dispensing nozzle. The nozzle is adapted to be removably positioned within the filler pipe of a receiving tank. It further includes means to form a sealed engagement between the dispensing nozzle and the tank filler tube.

In the instance of a closed or balanced system, the storage facility tank is usually vented to the atmosphere. With such an arrangement as the liquid fuel is pumped, one of two events could occur. If fuel volume leaving the system is not immediately replaced by a vapor volume from the tank being filled, air will be drawing into the system. On the other hand, when a vapor volume in excess of the fuel volume comes from the tank being filled, some of the vapor will be vented. However, these exiting vapors must first be processed such that their discharge is not harmful to the environment.

Several embodiments of sealing arrangement have been found to be advantageous for providing the necessary vapor tight disconnectable connection in the nozzle spout. One method for providing the desired seal is to attach a substantially cylindrical flexible walled member such as a rubber boot or the like to the fuel dispensing nozzle. The boot, at the tank neck contact end, is equipped with a face seal containing a resilient contact surface.

By use of such an arrangement, when the nozzle is registered in the filler pipe of a receiving tank, the walls of the flexible boot will be deflected or distorted. The boot will therefore define an annular vapor passage while a resilient contact face sealably engages the tank filler pipe.

This type of arrangement has generally been found to be effective. Thus, when a fuel flow is introduced from the dispensing nozzle into the receiving tank, a slight pressure is produced within the latter to displace fuel vapor-air mixture. This displaced mixture will be urged through the passage defined by the nozzle spout and the flexible walled boot. Said mixture is then transferred by way of the dispensing nozzle through a separate conduit, to the fuel source.

The effectiveness of a balanced system depends to a large extent on the mechanical compatibility of the vehicle with the dispensing nozzle to permit a tight seal at the interface thereof. If for any reason the contact edges of the nozzle cannot engage the filler pipe, a seal cannot be readily achieved and a leak will result or subsequently develop. In addition if the resilient sealing face and rubber boot are not adequately maintained, leaks will result at those points.

Another potential source of vapor leakage is through the above tank venting means. Such tanks are normally present on vehicles, particularly those manufactured prior to 1971. When a leakage path does develop or exist at least some of the vapor that would normally enter the receiving tank, will enter into the atmosphere. Thus, in conjunction with closed or balanced fuel systems, vacuum assist means such as jet pumps, fans, blowers, etc. have been devised which cause the vapor collection system to operate under a slight vacuum. This condition tends to draw air into the fuel system through any leak paths which exist or develop. It further tends to inhibit the flow of vapor into the atmosphere.

Vacuum assist facilities, however, often embody the disadvantage of bringing in excessive amounts of air which could produce an undesired explosive mixture within the vapor space. Further, they could produce excessive vent pipe emissions due to the saturation of the excess air as it passes through the system in contact with gasoline. In addition they could place heavy burdens on any vapor removal facilities downstream of the storage facility.

Of further note, the temperature of fuel held within the storage tank and the temperature of the fuel held within the tank being filled for the most part will determine the volume of vapor flow experienced during a filling operation. For example, at a temperature differential, very cool dispensed fuel flowing into a warm partly filled tank can occur, such that little vapor will flow from the tank being filled. It has been found, however, that the temperature differential, during most filling operations falls within a limited range, resulting in vapor/liquid volume ratios of unity or slightly less.

In the presently disclosed arrangement, a system is provided which incorporates features which include (1) a tight seal at the vehicle nozzle interface for those vehicles which permit it; (2) a presure sensing device which will sense if the desired vacuum is available; (3) liquid chilling means to transfer heat from a fuel flow as the latter enters a receiving tank if a desired vacuum level is not available; (4) pressure/vacuum vent on the storage facility to maintain a desired pressure (vacuum) range in the storage facility and (5) provision to prevent air to leak through the nozzle between filling operations.

Toward assuring operation of the overall system under varying circumstances, a heat transfer system is included in the liquid fuel conduit or line. This system responds to pressure (vacuum) in the storage facility to reduce the temperature of the fuel dispensed and therefore reduce the vapor/liquid ratio to maintain or produce a vacuum in the storage tank.

An object of the invention, therefore, is to provide a fuel system which is adapted to minimize the passage of fuel vapors to the atmosphere. A further object is to provide a system which will maintain a vacuum at the nozzle tank filler neck interface. A still further object is to provide a system adapted to automatically obtain a desired vapor/liquid ratio during fuel pumping operations where a satisfactory vacuum is not maintained.

DESCRIPTION OF THE DRAWINGS

In the drawing, FIG. 1 is an environmental arrangement of the presently disclosed fuel system which connects an underground storage facility or tank with a receiving tank to be filled. The latter could be a tank contained on an automobile, a boat, or other vehicle.

The invention in brief, and referring to the drawing, comprises an overall system as shown in FIG. 1. A fuel storage tank 10 of the type normally found in service stations, is provided with an electrically driven gasoline supply pump 11. The latter is adapted to be actuated by an operator for removing the stored gasoline. Said pump 11 can be either at ground level with its inlet immersed in the fuel, but is preferably as shown, submerged in the liquid.

Pump 11 is communicated through an elongated fuel conduit 12 to a dispensing nozzle 13.

A heat transfer member 14 is interposed within the fuel transfer conduit 12 and connected to a refrigerating means 16 such as a refrigerant compressor. Thus, as fuel is passed from storage tank 10 it is refrigerated or chilled to a predetermined temperature prior to its entering the receiving tank 17, if such chilling is required to achieve the desired vacuum in the storage facility tank.

When dispensing nozzle 13 is engaged with the filler pipe 18 of receiving tank 17, a resilient walled boot 19 is deformed to define an annular passage or chamber 21 between the boot itself and the inwardly disposed nozzle spout 22.

During a fuel transfer operation, as fuel is discharged through nozzle 13, a return flow of vapor to tank 10 by way of a second conduit 23 is enhanced by the degree of vacuum established in main tank 10 as a result of the liquid being withdrawn and the vapor/liquid ratio which is generally less than 1. As mentioned, receiving tank 17, which is being filled, is normally of the type found on an automobile or a boat wherein the liquid is held either in an enclosed or vented container. The latter is usually provided with at least one filler pipe 18 which extends from the tank a predetermined distance. The filler pipe closure member comprises a removable pressure/vacuum venting cap, and a vented cannister of adsorbent, which are not shown, which arrangement does not permit pressurization of vapors within fuel tank 17.

This vented type of system of course would avoid build-up of vapor pressure particularly under warm weather conditions. Filler pipe 18 can be either curved or straight as presently shown. It may further be of the type adated to accommodate only unleaded fuel. The inlet end of the filler pipe is provided with a lip or sealing surface which is normally conformed to receive the engaging surface of the filler cap or nozzle seal face.

Dispensing nozzle 13 is of the type normally utilized at service stations and is manually operable to commence and regulate fuel flow. It further includes means for automatically discontinuing the flow. The latter is achieved by providing pressure sensitive means to close the main flow control valve at such time as the fuel tank is filled or in the instance of a closed system, when an excessive pressure build-up exists.

Physically, dispensing nozzle 13 includes an elongated body 26 which functions as a handle for manipulating the nozzle. Said body 26 is provided with a plurality of flow passages, i.e., passage 27 for carrying liquid into the receiving tank 17 by way of conduit 12. Similarly it conducts vapors away from the receiving tank 17 which in the present instance are directed through chamber 21 and passage 28 into storage tank 10.

Nozzle body 26 is further provided at the handle end with a connection for engaging the elongated fuel carrying conduit 12 as well as the vapor carrying conduit 23. The forward end of said body 26 is provided with extended spout 22 which communicates with the nozzle fuel passage 26 by way of main flow control valve 31. Spout 22 is of sufficient length to be received into the tank filler pipe 18 prior to a fuel transfer operation. Spout 22 also includes means to fixedly engage the filler pipe, which means can comprise an external locking ring or the like so positioned where the nozzle will be self-maintained in place.

The nozzle body 26 is further provided with elongated resilient walled boot 19. The latter in one form comprises a bellows-shaped rubber member having sufficiently flexible walls that they can deform in response to force applied thereto. One end of the cylindrical boot sealably depends from the nozzle body. The boot other end is open and provided with a sufficiently resilient face to engage the lipped open end of the filler pipe 18 when properly positioned with respect to the spout. Boot 19 further forms an annular closure or chamber 21 into which vapor flows, such that vapor which is received in the annular chamber 21 from fuel tank 17 can be directed to storage tank 10.

The fuel storage means in the instance of most automotive service stations, comprises primarily one or more submerged tanks or storage facilities such as tank 10, which are filled by a tanker, truck or other supply vehicle. The electrically powered main pump 11 can be positioned above the ground level, although preferably it is submerged into the tank, having a suction or inlet side communicated with a fuel riser pipe 32. The lower end of said pipe 32 can be provided with a filter 38 disposed at the tank floor, or with other means for removing solids from the fuel prior to the latter being withdrawn. The upper end of said pipe 32 is provided with a fuel flow meter 35. The upper or center portion of the liquid conducting system includes a chilling or refrigerating element 14, interposed in said system in a manner that the temperature of the fuel flowing from the main storage tank 10 can be reduced. In the present instance the chilling system comprises a refrigeration or liquid conditioning means including heat tranfer or heat exchange member 14, which is connected in series with the fuel carrying conduit 12. Thus, all fuel leaving storage tank 10 and pump 11, will pass through a chilling passage 33 within the heat transfer member 14. The latter of course can comprise a coiled or similar elongated path adapted to achieve most efficient removal of heat from the liquid.

A second heat transfer coil 34 is communicated with the refrigeration system which, in the normal manner, can comprise a compressor 16 and condenser 46 arrangement such that refrigerant is pumped through an expansion valve 42 and cooling evaporator, the latter being here represented by heat transfer coil 34.

Underground tank pressure sensor 36 will call for operation of the refrigerator only if the system pressure increases beyond a point such as 0.1 inches of water.

Interlocking circuits such as 40, which goes to a temperature sensor in the heat exchanger 14, and 37 which goes into the fuel pump 11, limits the operating time of the refrigerator.

An automatic vacuum pressure vent valve 41, is used to limit the vacuums produced by consistent vapor/liquid ratios less than one or pressures produced when vapor/liquid ratios are greater than one with the refrigeration system not operational.

A valve, in the vapor recovery line at 39, only opens when fuel is flowing, preventing the loss of vacuum between fillings if the nozzle is found to leak.

Operationally the present system includes pressure sensing means 36 controlling the refrigeration system and vent means 41 such that normally, the degree of vacuum in tank 10 will be maintained at a substantially desired level. This level is contingent upon the relative flow between the main storage tank 10 and the receiving tank 17 of the vapor and liquid defined as the vapor/liquid ratio. As herein mentioned a preferred normal condition is said ratio slightly below unity, which will result in a vacuum condition in the tank. By maintaining the vacuum level in the desired range the system will be permitted to operate most efficiently and effectively, preventing the transfer of the vapor to the atmosphere and minimizing the flow of air into the system. Under ideal conditions, the storage tank 10 will be operating in a pressure range of 0.1 inches of water vacuum to 0.77 inches of water vacuum. This presumes that the storage tank vent means 41 is set to relieve pressure at about 0.77 inches of water.

At such time as the vacuum conditions within storage tank 10 measured by sensor 36 get below 0.1 inches of water toward atmosphere the instant refrigeration system compressor 16 will become actuated.

The operation of the refrigeration system compressor 16 will only occur if the fuel pump 11 has been actuated, by other means not shown, as signaled through line 37 or if the temperature sensed in the heat exchanger 14 by line 36 is above a predetermined level.

The vacuum vent line will only allow vapor flow when valve 39 is open which occurs when fuel is flowing.

When either the desired pressure (vacuum) level is reached or the fuel pump shuts off, the refrigerator will shut off.

Other modifications and variations of the invention as hereinbefore set forth can be made without departing from the spirit and scope thereof, and therefore, only such limitations should be imposed as are indicated in the appended claims.

I claim:

1. In a system for conducting a vaporizable fuel from a storage facility therefor, into a receiving tank having an inlet port, and for concurrently conducting a vapor-ous stream from said receiving tank to said storage facility, which system includes;

a fuel dispensing nozzle detachably, sealably connected with said receiving tank inlet port, a liquid pumping circuit, including pumping means having a pump inlet communicated to a source of fuel in said storage facility, and having a discharge port, and an elongated conductor including a liquid carrying conduit communicating said fuel dispensing nozzle with said pumping means discharge port, and a vapor carrying conduit communicating said nozzle with said storage facility, the improvement therein of a heat transfer member disposed intermediate said pumping means discharge port and said liquid carrying conductor to receive a stream of fuel from said storage facility and to adjust the temperature of said fuel stream prior to said stream entering said receiving tank.

2. In the system as defined in claim 1, including control means communicated with said heat transfer member, being operable to regulate the degree of heat transfer achieved on said fuel stream.

3. In the system as defined in claim 2, wherein said control means is operable to lower the temperature of liquid fuel which leaves said heat transfer member.

4. In the system as defined in claim 2, wherein said control means is operable to regulate the temperature of said fuel leaving said storage facility, and including temperature sensing means operable to monitor the temperature of fuel at said storage facility as well as the ambient temperature.

5. In the system as defined in claim 1, wherein said heat transfer member includes refrigerating means communicated therewith, the latter being operable to regulate the degree of heat transfer within said heat transfer member.

6. In the system as defined in claim 1, wherein said heat transfer member includes a heat exchange element communicated to receive said fuel stream, and conduit means communicating said heat transfer member with a source of heat transfer fluid.

7. In the system as defined in claim 1, wherein said heat transfer member includes a heat exchange passage communicated to receive said fuel stream, and being in heat exchange contact with means for passing a chilled heat exchange medium therethrough.

* * * * *